US007119299B2

(12) United States Patent
Kojima et al.

(10) Patent No.: US 7,119,299 B2
(45) Date of Patent: Oct. 10, 2006

(54) WORK INSPECTION SYSTEM

(75) Inventors: Tomoyuki Kojima, Tokyo-To (JP); Hiroaki Abe, Tokyo-To (JP); Shigeru Matsukawa, Tokyo-To (JP); Takahiko Iwazaki, Tokyo-To (JP); Takayuki Yamauchi, Tokyo-To (JP)

(73) Assignee: Tokyo Weld Co., Ltd., Tokyo-to (JP)

( * ) Notice: Subject to any disclaimer, the term of this patent is extended or adjusted under 35 U.S.C. 154(b) by 0 days.

(21) Appl. No.: 10/758,202

(22) Filed: Jan. 16, 2004

(65) Prior Publication Data

US 2004/0159591 A1 Aug. 19, 2004

(30) Foreign Application Priority Data

Jan. 20, 2003 (JP) ..... 2003-011060

(51) Int. Cl.
*B07C 5/344* (2006.01)
*B07C 5/00* (2006.01)

(52) U.S. Cl. ..... 209/573; 209/552

(58) Field of Classification Search ..... 209/905, 209/571, 919, 573
See application file for complete search history.

(56) References Cited

U.S. PATENT DOCUMENTS 2,316,375 A * 4/1943 Van Haften ..... 209/581
3,097,743 A * 7/1963 Scholten et al. ..... 209/565
5,842,579 A * 12/1998 Garcia et al. ..... 209/573

FOREIGN PATENT DOCUMENTS

| | | |
|---|---|---|
| JP | 06-269744 A | 9/1994 |
| JP | 2001-026318 A | 1/2001 |
| JP | 2002-113427 A | 4/2002 |

* cited by examiner

*Primary Examiner*—Kathy Matecki
*Assistant Examiner*—Terrell Matthews
(74) *Attorney, Agent, or Firm*—Birch, Stewart, Kolasch & Birch, LLP

(57) ABSTRACT

A work inspection system 2 includes: a conveyor table 7 vertically positioned, and conveying works W stored in work-storing pockets 9; a work inspection apparatus for inspecting the works stored in the work-storing pockets 9 of the conveyor table 7; and a sorting and ejecting apparatus 12 for sorting the inspected works stored in the work-storing pockets of the conveyor table in accordance with a property of the works and ejecting the same. The work-storing pockets 9 of the conveyor table 7 are positioned inside the periphery 7*a* of the conveyor table 7 to surround the works W. The work-storing pockets 9 are disposed along two concentric circles on the conveyor table 7.

14 Claims, 10 Drawing Sheets

WORK INSPECTION SYSTEM

This Nonprovisional application claims priority under 35 U.S.C. § 119(a) on Patent Application No(s). 2003-011060 filed in Japan on Jan. 20, 2003, the entire contents of which are hereby incorporated by reference.

FIELD OF THE INVENTION

The present invention relates to a work inspection system for inspecting (checking and measuring) such works as chip-type electronic components, while conveying the same.

RELATED ART

A work inspection system is conventionally known which includes a conveyor table with a storing groove which is outwardly opened and disposed at an outer periphery of the conveyor table, and a work inspection apparatus which inspects works stored in the storing groove of the conveyor table. (See, for example, Japanese Patent Laid-Open Publication No. 181214/1995).

In such a work inspection system, the works are supplied to the conveyor table and inserted in the storing groove. Then, with a rotation of the conveyor table, the works are conveyed to the work inspection apparatus which inspects (checks and measures) the works.

OBJECT TO BE SOLVED BY THE INVENTION

In the above work inspection system, the works supplied to the conveyor table are stored in the storing groove which is outwardly opened and disposed at the outer periphery of the conveyor table. The works stored in the storing groove of the conveyor table are conveyed in accordance with a rotation of the conveyor table. Since the storing groove is outwardly opened, it is difficult to convey and inspect the works while stably holding them in the storing groove.

A work is generally of a rectangular parallelepiped shape. An inspection of such a work is carried out via electrodes disposed on ends of the longest edges of the works. Thus, the work in the storing groove must have electrodes in a vertical direction of the conveyor table. Therefore, a dimension of the storing groove is formed such that the work can enter the storing groove from a side of the electrodes, but that the work cannot enter the same from the longest edges. Thus, in the system where the works are supplied to the conveyor table with their orientations varied (in a random manner), a storing efficiency of the works in the storing groove is degraded. To improve this disadvantage, Japanese Patent Laid-Open Publication No. 181214/1995 proposes a gravitational agitation caused by inclining the conveyor table, or a forced agitation caused by, for example, blowing compressed air to a work reservoir of the supplied works. Although some improvement can be expected, the works cannot be constantly supplied to the storing groove in a stable manner.

The present invention is made in light of the above disadvantages. It is an object of the present invention to provide a work inspection system which can supply and convey the works by a conveyor table while stably holding the works.

SUMMARY OF THE INVENTION

A work inspection system according to the present invention comprises: a conveyor table vertically positioned, and including a plurality of work-storing pockets for storing works, the work-storing pockets being formed inside the periphery of the conveyor table; a work supply apparatus for supplying the works to the conveyor table; a work inspection apparatus for inspecting the works stored in the work-storing pockets of the conveyor table, the work inspection apparatus being disposed near the conveyor table; and a sorting and ejecting apparatus for sorting the inspected works stored in the work-storing pockets of the conveyor table in accordance with a property of the works and ejecting the same; wherein the work-storing pockets of the conveyor table are positioned along one or more concentric circles.

In the work inspection system, a table base may be disposed on a rear surface of the conveyor table; and circumferential vacuum sucking grooves, which are in communication with the work-storing pockets of the conveyor table and in communication with a vacuum system, may be formed in the table base.

In the work inspection system, the work-storing pockets of the conveyor tables may be in communication with the vacuum sucking grooves of the table base through communication grooves.

In the work inspection system, the work supply apparatus may include an inclined guide chute for supplying the works, which is downwardly inclined to the conveyor table; and a distribution chute for introducing the works from the inclined chute to the work-storing pockets.

In the work inspection system, the work supply apparatus may include a horizontal guide chute for supplying the works, which is horizontally extended to the conveyor table; and a distribution chute for introducing the works from the horizontal guide chute to the work-storing pockets.

In the work inspection system, a driving mechanism for driving the works in the horizontal guide chute may be disposed on the horizontal guide chute.

In the work inspection system, the distribution chute may have V-shaped transfer grooves which are in communication with the work-storing pockets.

In the work inspection system, the work supply apparatus may include the horizontal guide chute for supplying the works, which is horizontally extended to the conveyor table, and the horizontal guide chute may have V-shaped transfer grooves which are in communication with the work-storing pockets.

In the work inspection system, each V-shaped groove may have a V-shaped cross-section whose opening degree is equal to or more than 90°.

In the work inspection system, the work supply apparatus may further include means for detecting a remaining amount of the works in the distribution chute.

In the work inspection system, the work inspection apparatus may have a pair of probes being capable of contacting the works in the work-storing pockets from the front and rear surfaces of the conveyor table, and the probe on the rear surface side of the conveyor table may be supported by a base which is disposed on the rear surface of the conveyor table through the table base.

In the work inspection system, the probe on the rear surface side of the conveyor table may be held on the base by a clamp bar which is slid on the base by a rotation of an eccentric cam.

In the work inspection system, the sorting and ejecting apparatus may include means for jetting air to the works in the work-storing pockets, the means being disposed on the rear surface side of the conveyor table.

In the work inspection system, a pusher for pushing the conveyor table to disengage the same from the table base may be disposed on the rear surface side of the conveyor table.

DETAILED DESCRIPTION OF THE INVENTION

Embodiments of the present invention are described below with reference to the drawings.

FIRST EMBODIMENT

FIGS. 1 to 14 show a first embodiment of a work inspection system according to the present invention.

Figure 1:
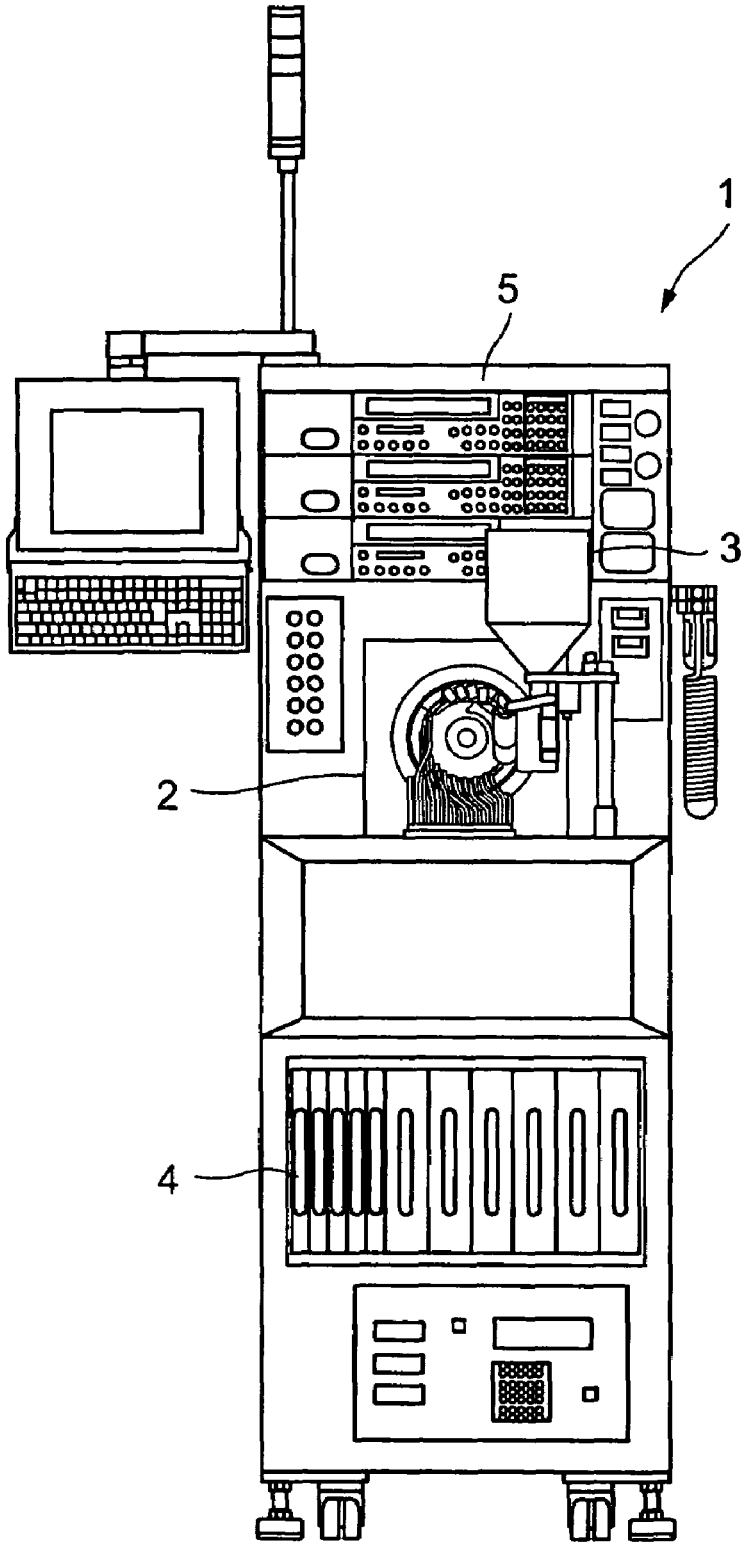
FIG. 1 is a view showing an automatic inspecting and sorting apparatus in which a work inspection system according to the present invention is installed.

Referring to FIG. 1, an automatic inspecting and sorting apparatus 1 is described as a whole. As shown in FIG. 1, the automatic inspecting and sorting apparatus 1 includes: a hopper 3 wherein works W which are not yet inspected are stored; a work inspection system 2 according to the present invention which conveys the works W from the hopper 3 and inspects the same; a storing box 4 wherein the works W which are inspected and ejected by the work inspection system 2 are sorted and stored; and a controller 5.

The work inspection system 2 according to the present invention is described below. As shown in FIGS. 2 to 6, the work inspection system 2 includes: a conveyor table 7 vertically positioned, and having a plurality of work-storing pockets 9 for storing works W, the work-storing pockets 9 being formed inside the periphery of the conveyor table 7; a work supply apparatus 13*a* for supplying the works W to the conveyor table 7; a work inspection apparatus 17 for inspecting (checking and measuring) the works W in the work-storing pockets 9 of the conveyor table 7; and a sorting and ejecting part 12 for sorting the inspected works W in the work-storing pockets 9 of the conveyor table 7 in accordance with a property of the works W and ejecting the same.

The plurality of work-storing pockets 9 of the conveyor table 7 are positioned along a plurality of, e.g., two concentric circles of different semidiameters.

The conveyor table 7 is disposed on a surface of a base 6 vertically disposed on the automatic inspecting and sorting apparatus 1 through a table base 8. A guide 10 for guiding the conveyor table 7 is disposed on the base 6. The guide 10 has an annular shape, and has a V-shaped portion at a lower part of the periphery.

The conveyor table 7 is of a disk shape, and rotates about a driving shaft 46.

That is, the driving shaft 46 of the conveyor table 7 is fitted in a bearing 47 passing though the base 6, and is connected to a not shown driving means to rotate the conveyor table 7.

An openable and closable cover unit 11 for covering the conveyor table 7 and the guide 10 is disposed on the base 6 through a hinge 16. The cover unit 11 has a cover ring 11*a* and a transparent cover plate 11*b* fitted in an inner periphery of the cover ring 11*a*.

The work supply apparatus 13*a* is described below. The work supply apparatus 13*a* includes a cylindrical guide chute 13, and a distribution chute 14 connected thereto.

The cylindrical guide chute 13 has an end opening 13*b* passing through the cover plate 11*b*. The end opening 13*b* faces a vertical surface of the conveyor table 7, and opens to a rear surface (a surface opposed to the conveyor table 7) of the cover plate 11*b*. The other end of the guide chute 13 is substantially horizontally cut to form an opening 13*c*. That is, the openings 13*b* and 13*c* of the guide chute 13 are substantially perpendicular to each other. An inclined edge between the openings 13*b* and 13*c* provides a chute surface 13*d* of the guide chute 13.

The distribution chute 14, which is connected to the end opening 13*b* of the guide chute 13 as described above, is disposed on the rear surface of the cover plate 11*b*. When the cover unit 11 is closed to cover the conveyor table 7, a surface of the guide chute 14 which is opposite to the guide chute 13 is opposed to a surface of the conveyor table 7. A narrow gap is formed between the distribution chute 14 and the surface of the conveyor table 7. The gap is formed such that the works W sent from the distribution chute 14 to the conveyor table 7 would not be caught therein.

Figure 4:
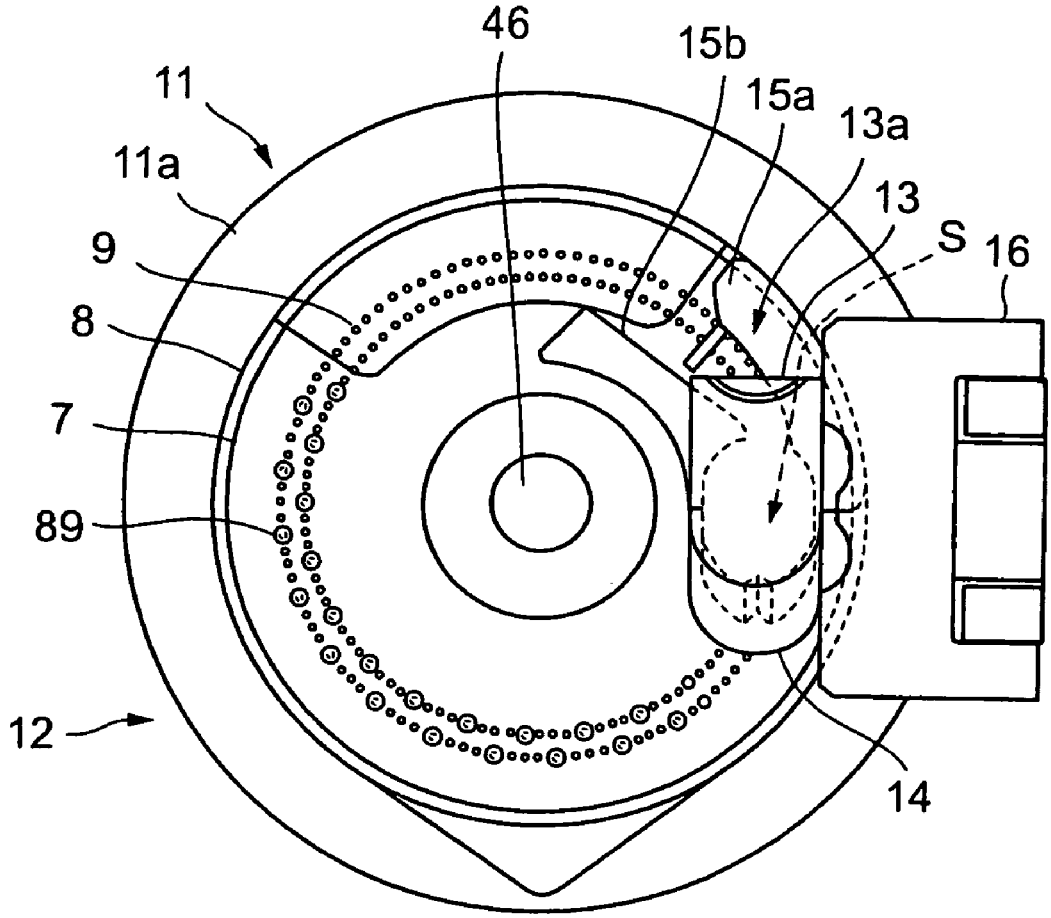
FIG. 4 is a front view of the work inspection system shown in FIG. 2.

As shown in FIG. 4, two guides 15*a* and 15*b* being in contact with the distribution chute 14 are disposed on the surface of the conveyor table 7. The guides 15*a* and 15*b* together with the distribution chute 14 are secured to the cover plate 11*b*. A narrow gap is formed between the guides 15*a* and 15*b* and a rear surface of the conveyor table 7, the gap being formed such that the works W would not be caught therein. The guides 15*a* and 15*b* together with the distribution chute 14 define a reservoir space S (FIGS. 4 and 7) for the supplied works W, and provide a guide surface of a work conveyor channel.

Figure 5:
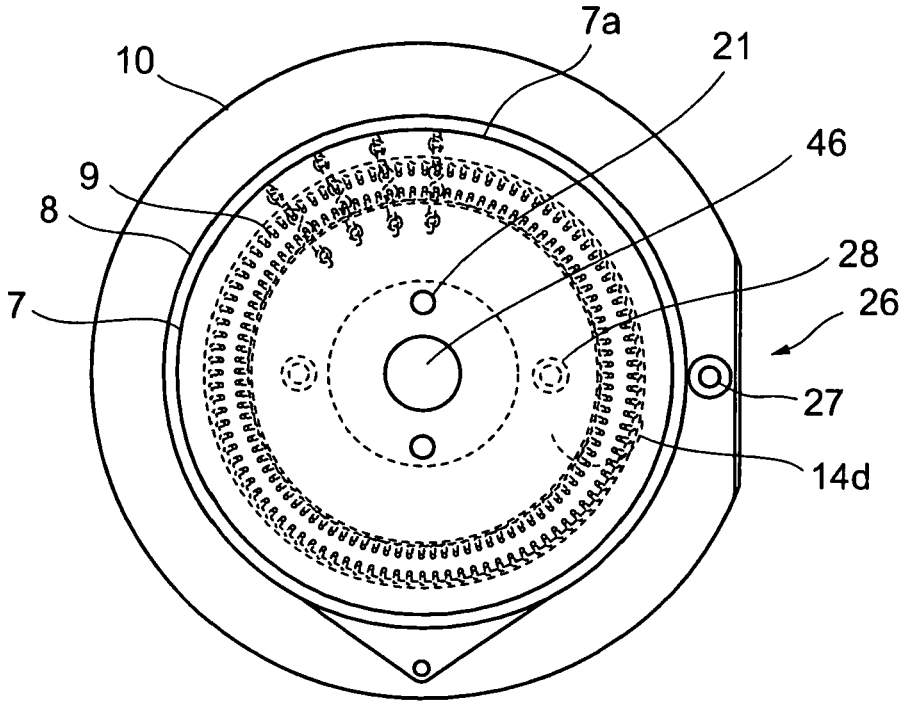
FIG. 5 is a view showing the work inspection system shown in FIG. 2, with a cover unit being detached therefrom.

Referring to FIG. 5, the work-storing pockets 9 formed in the conveyor table 7 are described below. As shown in FIG. 5, the conveyor table 7 is rotatably set on the table base 8 by means of a positioning pin 21. The plurality of work-storing pockets 9 passing through the conveyor table 7 are annularly positioned on the conveyor table 7 with certain intervals therebetween. The work-storing pockets 9 are positioned inside a periphery 7*a* of the conveyor table 7 along two concentric circles of different semidiameters to form two lines.

Figure 8:
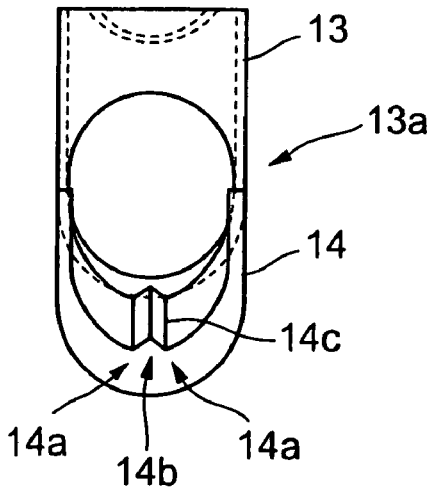
FIG. 8 is a view showing a guide chute and a distribution chute which are viewed from a side of a conveyor table.
Figure 9:
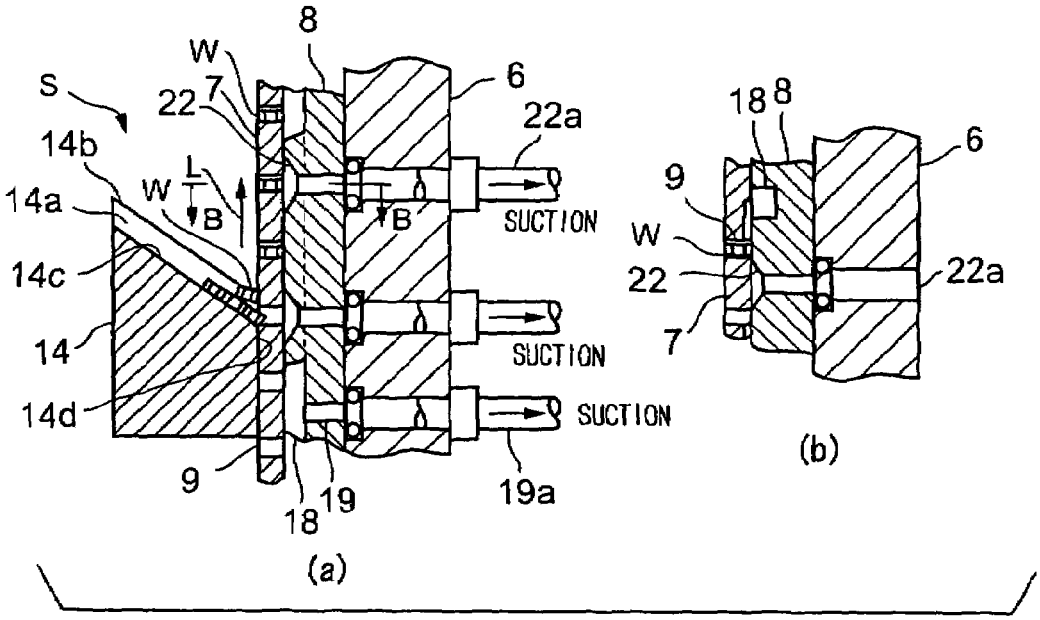
FIG. 9 is a cross-sectional view of a conveyor table in a vicinity of a distribution chute.

Referring to FIGS. 8 and 9, the distribution chute 14 is described below. The distribution chute 14 has a planar surface 14*d* which is formed by an inner periphery of an end of the distribution chute 14 at a portion opposed to the conveyor table 7. The planar surface 14*d* covers a part of the work-storing pockets 9 which are concentrically arranged in two lines.

As shown in FIG. 8 which is viewed from a side of the conveyor table 7, the distribution chute 14 has a plurality of V-shaped transfer grooves 14*c* each of which is formed by recessed portions 14*a* and a projected portion 14*b*. Each V-shaped transfer groove 14*c* has a V-shaped cross-section in which a degree of the recessed portions 14*a*, viewed in a vertical cross-section of the V-shaped transfer groove 14*c*, is equal to or more than 90°. As shown in FIG. 9, the transfer grooves 14*c* of the distribution chute 14 are downwardly inclined toward the conveyor table 7. Lower ends of the transfer grooves 14*c* are positioned on the lines of the plurality of work-storing pockets 9. An inclination angle of each transfer groove 14*c* is preferably about 35° with respect to a horizontal surface.

Figure 6:
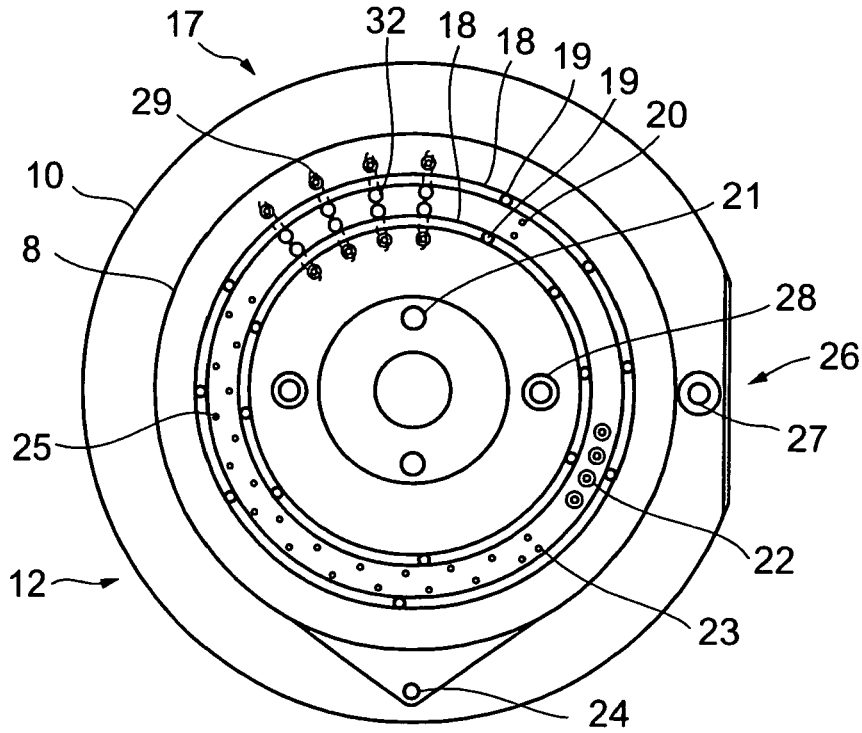
FIG. 6 is a view showing the work inspection system shown in FIG. 5, with a conveyor table being detached therefrom.

A vacuum mechanism of the work-storing pockets 9 of the conveyor table 7 is described below. As shown in FIG. 6 in which the conveyor table 7 is detached from the illustration shown in FIG. 5, two vacuum sucking grooves 18 corresponding to the lines (two lines in this embodiment) of the work-storing pockets 9 are concentrically disposed on the table base 8. A plurality of vacuum sucking holes 19 passing through the table base 8 are arranged in the respective vacuum sucking grooves 18.

Figure 10:
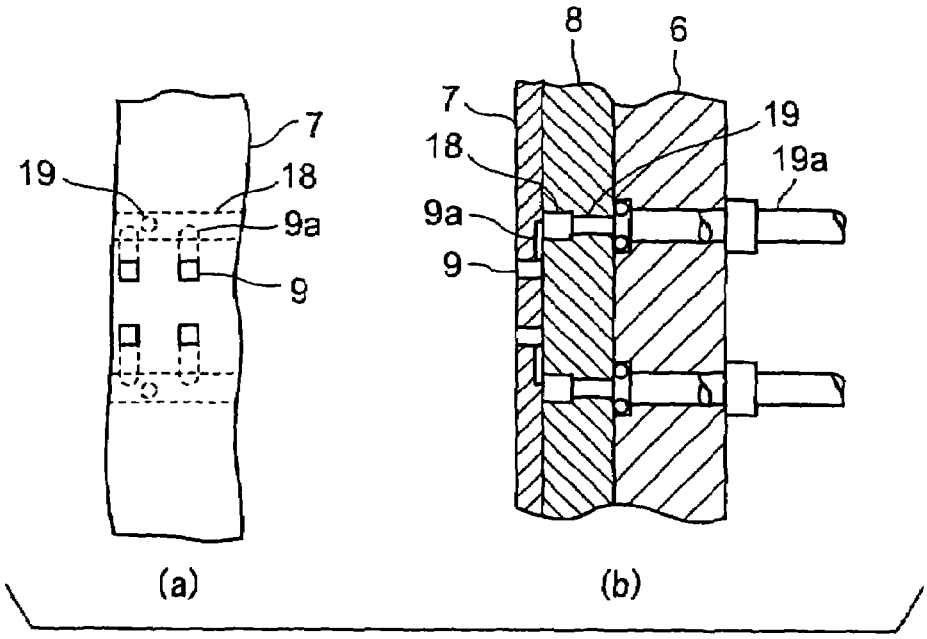
FIG. 10 is a view showing a relation of a work-storing pocket and a vacuum sucking hole.

As shown in FIG. 10, the vacuum sucking holes 19 are connected to a not shown vacuum generating source through vacuum pipes 19*a* passing through the base 6. A vacuum mechanism is formed by the vacuum generating source, the vacuum pipes 19*a*, and the vacuum sucking holes 19. The vacuum mechanism is connected to the work-storing pockets 9 through the vacuum sucking grooves 18 and sucking grooves 9*a* disposed on the conveyor table 7.

As shown in FIG. 9(*a*), in the reservoir space S for the works W which is formed by the distribution chute 14, a plurality of sucking holes 22 passing through the table base 8 are disposed between the two vacuum sucking grooves 18 (FIG. 6). The sucking holes 22 are for assisting a loading of the works W in the work-storing pockets 9. The sucking holes 22 are connected to a not shown vacuum generating source through sucking pipes 22*a* passing through the base 6. As shown in FIG. 9(*b*) which is a cross-section taken along the line B—B of FIG. 9(*a*), since the storing pockets 9 for the works W are partially in communication with sucking holes 22, the works W would not be sucked into the sucking holes 22.

Figure 2:
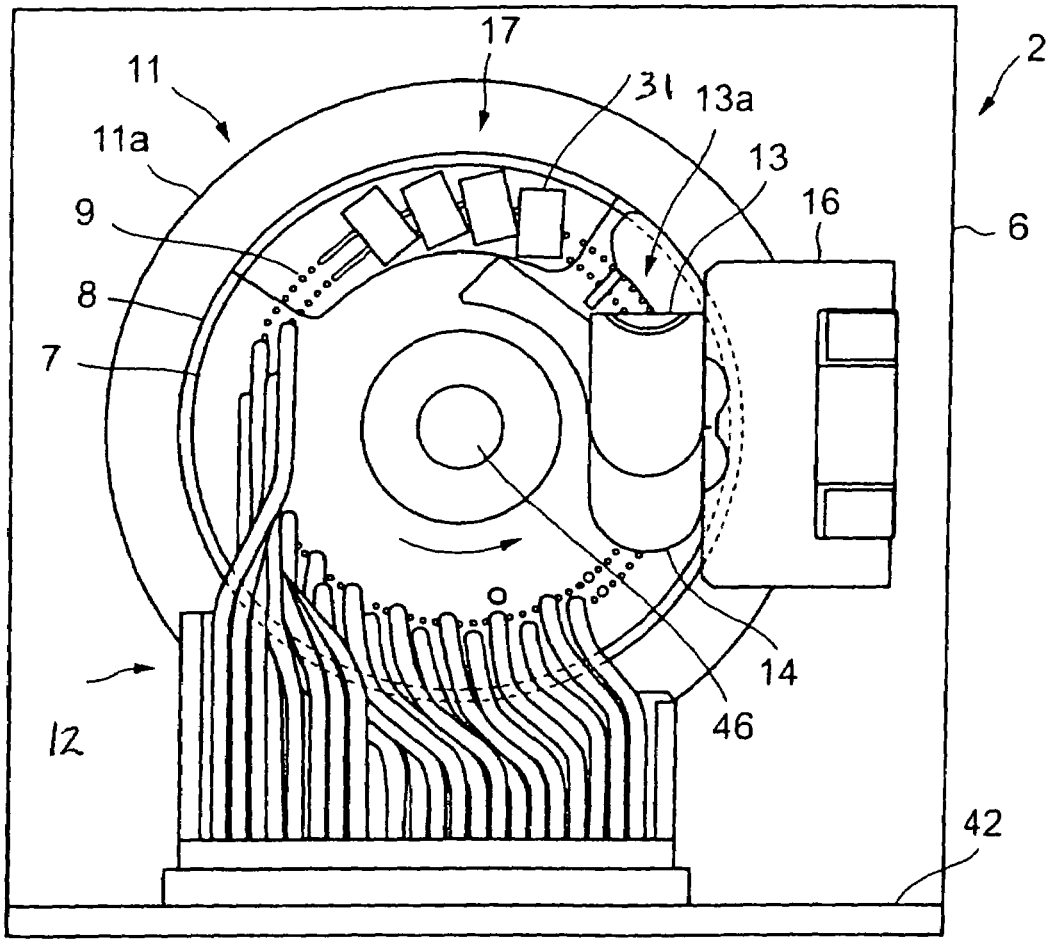
FIG. 2 is a view showing a first embodiment of a work inspection system according to the present invention.

As shown in FIG. 2, the inspection apparatus 17 and the sorting and ejecting part 12 are disposed on the downstream of the guide chute 13 and the distribution chute 14, and along the lines of the work-storing pockets 9.

Figure 11:
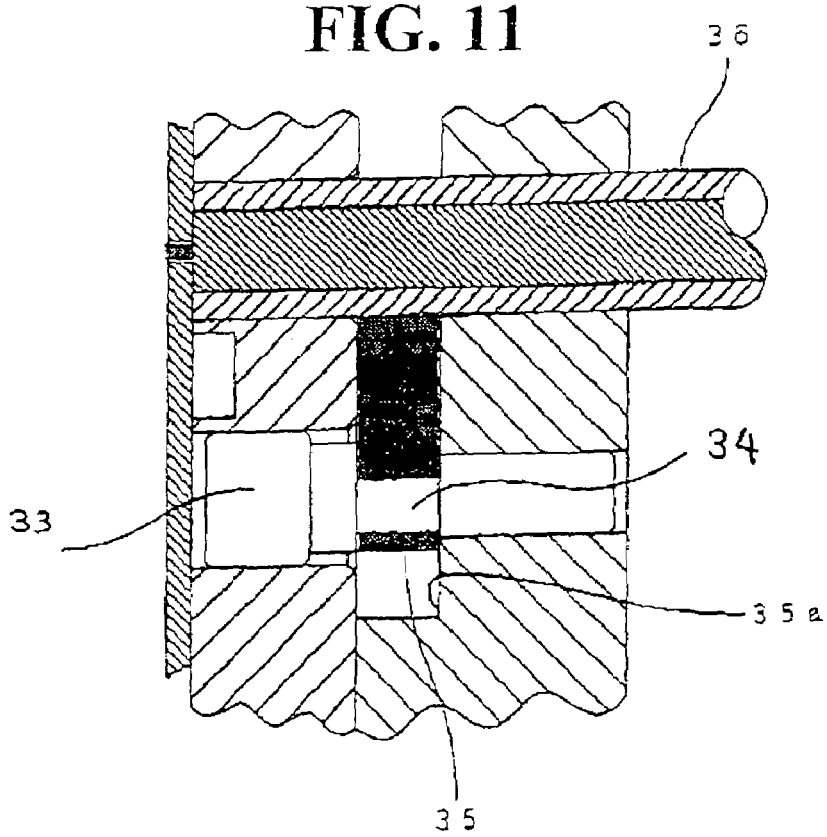
FIG. 11 is a view showing a work inspection part.

As shown in FIG. 11, the inspection apparatus 17 has one or more base probes 36 passing through the table base 8 and the base 6, and one or more inspection units 31 disposed on the cover unit 11 through a not shown insulation base. One end of the base probe 36 is set substantially coplanar with a work conveyor surface of the table base 8, and a signal cable 37 for transmitting a signal to the controller 5 (FIG. 1) is connected to the other end of the base probe 36.

The inspection unit 31 has an inspection probes 32 which are opposed to the base probes 36. The probes 32 and 36 are configured to contact the electrodes disposed on both ends of the works W which are stored in the work-storing pockets 9 of the conveyor table 7. Thus, the number of the inspection probes 32 should be equal to or more than the number of lines (two) of the work-storing pockets 9. The number of the inspection units 31 is determined by the number of the inspection probes 32 disposed on the inspection unit 31.

As shown in FIGS. 3, 6, 11, 12(*a*), and 12(*b*), in order to fix the base probe 36 on the base 6, a probe clamp mechanism 29 is disposed on every base probe 36. The base clamp mechanism 29 is adapted to clamp the base probe 36.

Figure 12A:
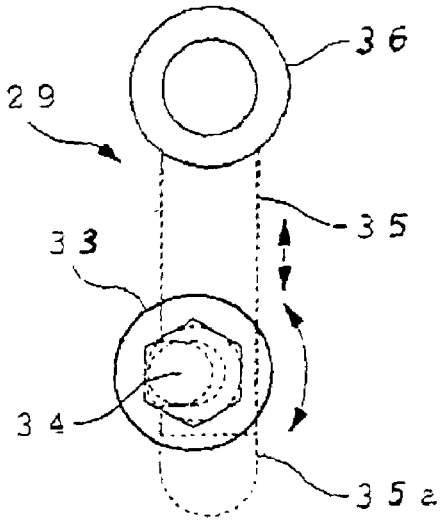
FIG. 12 is a view showing a probe clamp mechanism.
Figure 12B:
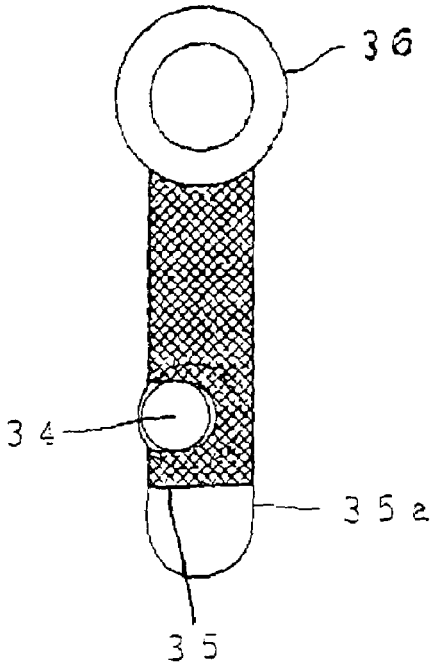

As shown in FIG. 12(*a*) and 12(*b*), the probe clamp mechanism 29 has a clamp bar 35 which is slid along a slide groove 35*a* disposed on the base 6. A clamp screw 33 is inserted from a through-hole of the table base 8. The clamp screw 33 has an eccentric cam 34 which is inserted to a notched portion of the clamp bar 35 (FIGS. 11 and 12). With a rotation of the eccentric cam 34, the base probe 36 is clamped through the clamp screw 33 and the clamp bar 35 to be held on the base 6.

As shown in FIGS. 2 and 6, the inspection unit 31 and the inspection probes 32 of the work inspection apparatus 17 are provided to cope with the inspection items; such as electrostatic capacity, insulation resistance, and withstand voltage.

Figure 3:
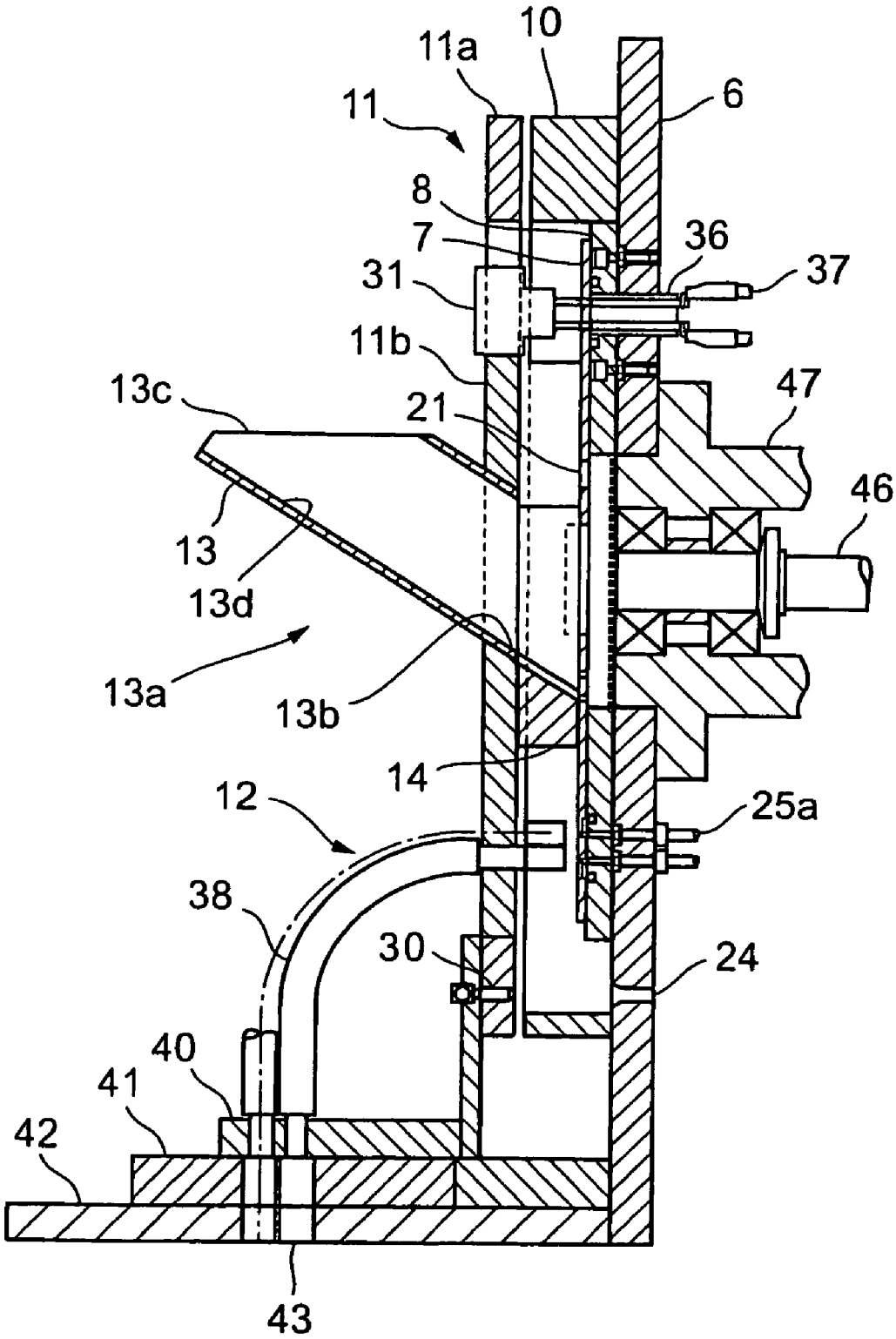
FIG. 3 is a cross-sectional view of the work inspection system shown in FIG. 2.
Figure 13:
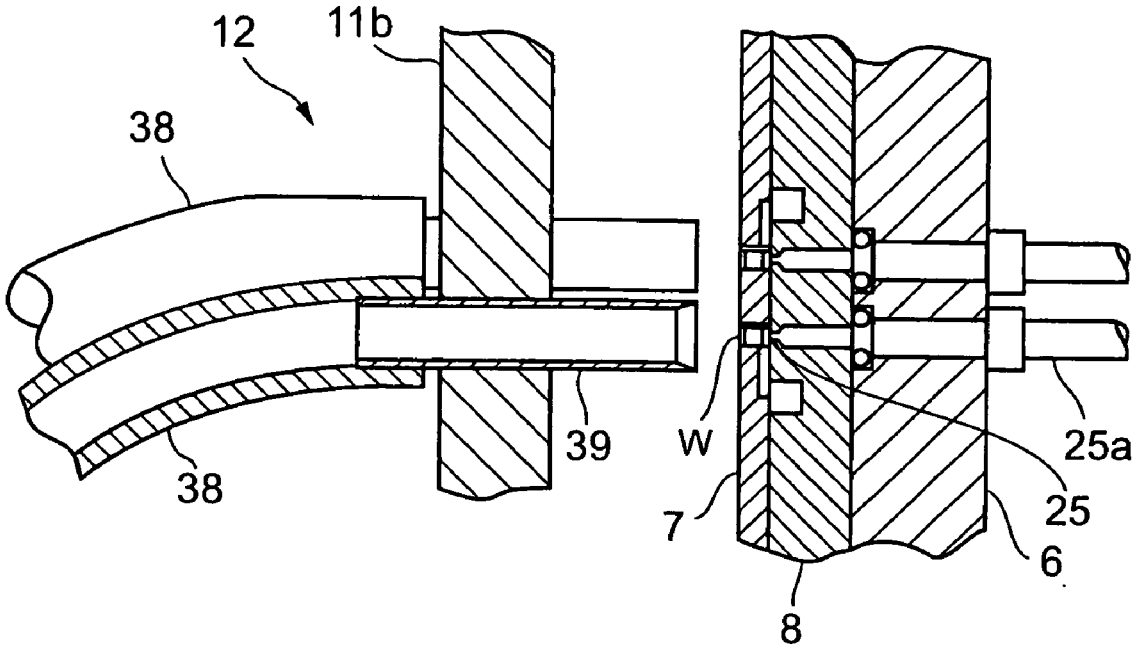
FIG. 13 is a cross-sectional view of a sorting and ejecting part.

Referring to FIGS. 2, 3, and 13, the sorting and ejecting part 12 is described below. As shown in FIG. 13, the sorting and ejecting part 12 has a jet hole 25 for ejecting the works W, the jet hole 25 passing through the table base 8. The jet hole 25 is connected to a not shown compressed air controlling means and a compressed air generating source through a compressed air pipe 25*a* passing through the base 6. Compressed air is jetted from the jet hole 25 onto the works W in the work-storing pockets 9 of the conveyor table 7.

An ejection pipe 39 passing through the cover plate 11*b* is disposed on a position opposite to the jet hole 25, with the conveyor table 7 between the ejection pipe 39 and the jet hole 25. The other end of the ejection pipe 39 passing through the cover plate 11*b* is fitted in one end of an ejection hose 38. As shown in FIG. 3, the other end of the ejection hose 38 is communicated with an ejection hose receiving plate 40. A through-hole of the ejection hose receiving plate 40 is in communication with an ejection pipe 43 of an ejection base 42 through a through-hole of an ejection junction plate 41, and is connected to the storing box 4 (FIG. 1) for the works W through a not shown pipe.

As shown in FIGS. 2, 4, and 6, the numbers of the jet hole 25, the ejection pipe 39, and the ejection hose 38 of the sorting and ejecting part 12 correspond to the required sorted number of works W inspected.

Figure 14:
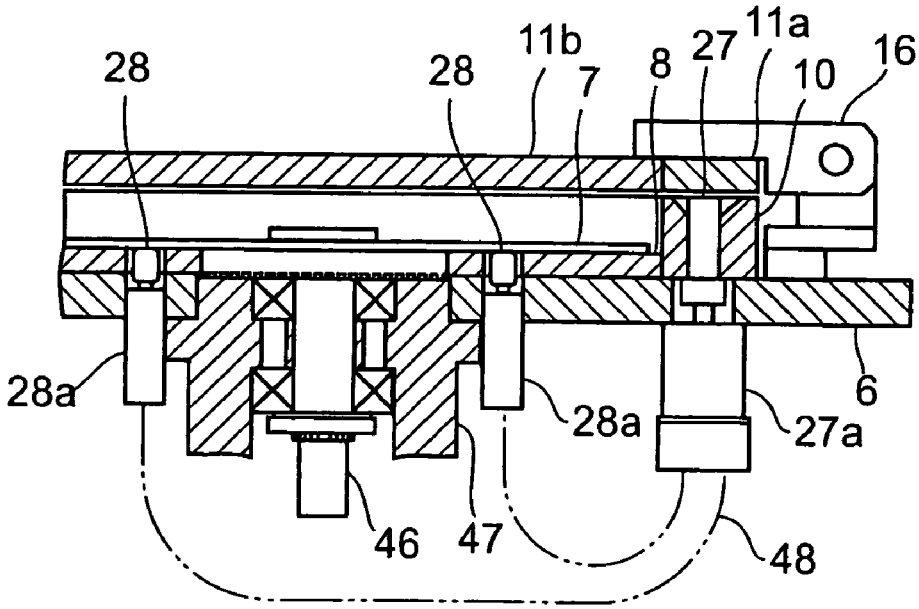
FIG. 14 is a view showing a manner of detaching a conveyor table from a table base.

As shown in FIGS. 5, 6, and 14, a plurality of pushers 28 and cylinders 28*a* for taking out the conveyor table 7 to replace the same are provided to pass through the table base 8 and the base 6. Each cylinder 28*a* is connected to a mechanical valve 27*a* through an air pipe 48. The mechanical valve 27*a* is secured to the base 6. The valves are opened and closed by a switch button 27 passing through the guide 10 and the base 6, so that the respective pushers 28 are extended to detach the conveyor table 7 from the table base 8.

Figure 7:
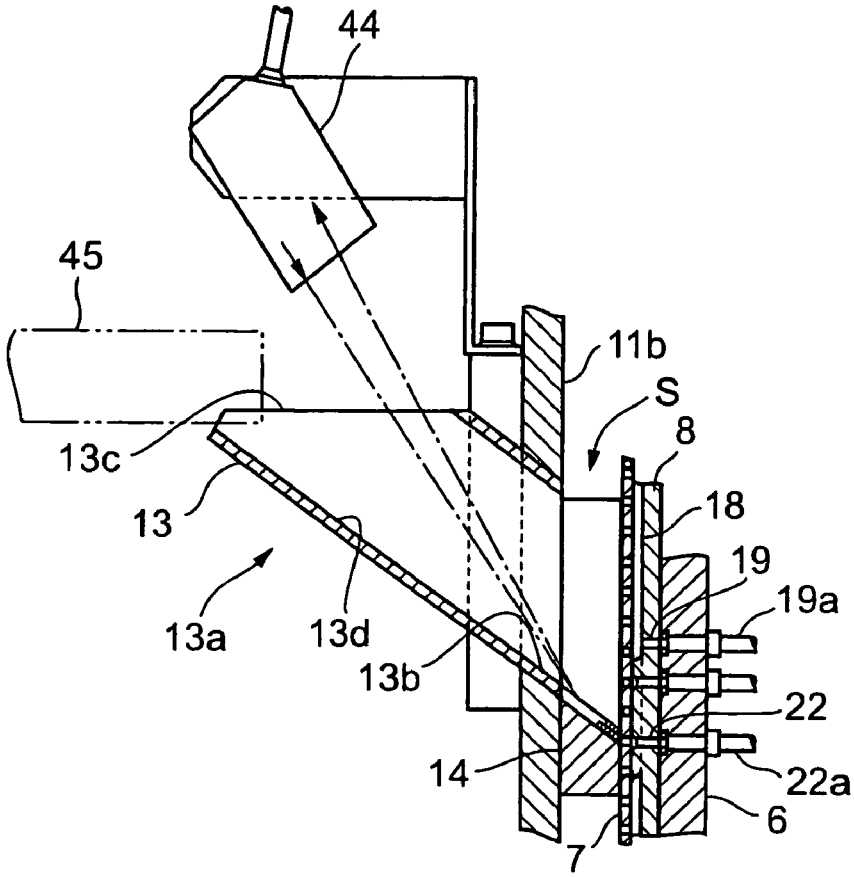
FIG. 7 is an enlarged cross-sectional view of a work supply part of a work inspection system.

As shown in FIG. 6, work sensors 20 and 23 are provided to pass through the table base 8. The work sensors 20 and 23 detect a presence of the works W loaded in the work-storing pockets 9 of the conveyor table 7. As shown in FIG. 7, a sensor 44 is disposed on the cover plate 11*b*. The sensor 44 detects a remaining amount of the works W in the reservoir space S above the distribution chute 14, when the works W supplied to the guide chute 13 from the hopper 3 through a linear chute 45 are slid down on the chute surface 13*d* of the guide chute 13 to be stored in the upper part of the distribution chute 14. The sensor 44 may preferably be a line sensor or a distance sensor.

In order to collect the defective works W which are dropped off in the course of the conveyance by the conveyor table 7, as shown in FIGS. 3 and 6, an ejection hole 24 passing through the base 6 is provided at the V-shaped portion formed in a lower part of the inner periphery of the guide 10. The ejection hole 24 is connected to a means (not shown) for storing ejected works through an ejection pipe. A jet nozzle 30 (FIG. 3) is provided which passes through the cover ring 11*a* of the cover unit 11, and is opposed to the ejection hole 24.

Operations of the work inspection system according to the present invention as constituted above are described below.

A plurality of works W of a rectangular parallelepiped shape stored in the hopper 3 are supplied from the upper opening 13*c* of the guide chute 13 through the linear chute 45. Then, the works W are slid down by gravitation along the chute surface 13*d* of the cylindrical guide chute 13 to reach an upper part of the distribution chute 14. The works W supplied to the distribution chute 14 are distributed by the projected portion 14*b* of an inverted V-shape (FIG. 8) of the distribution chute 14. Then, the works W are stored in the V-shaped transfer groove 14*c* formed by the right and left V-shaped recessed portions 14*a* on both sides of the projected portion 14*b*.

Since each work W is of a rectangular parallelepiped shape, and is guided by two inclined surfaces constituting the V-shaped recessed portions 14*a*, a longitudinal direction of the work W is conformed with a direction of the transfer groove 14*c*, regardless of the orientation of the work W when being supplied to the distribution chute 14. If a width direction of the work W is confirmed with the transfer groove 14*c*, the work W is rotated during sliding down because of an unstable arrangement of the work W. Then, the longitudinal direction of the work W is conformed with the transfer groove 14*c*, which leads to stability of the direction of the work W. Thus, the headmost and lowest work W can stably be moved to a leading end of the transfer groove 14*c*, that is, a position opposite to the lined work-storing pockets 9 of the conveyor table 7. An opening degree (a degree of a cross-section normal to the transfer groove 14*c*) formed by the two inclined surfaces of the V-shaped transfer groove 14*c* is slightly more than 90°. Thus, one of the four surfaces forming the longitudinal direction of the work W is mainly brought in contact with one of the two inclined surfaces of the V-shaped transfer groove 14*c*. As a result, a friction caused by the inclined surfaces of the V-shaped transfer groove 14*c* can be reduced, and the works W can smoothly be moved to the end of the transfer groove 14*c*. In transferring the works W from the transfer grooves 14*c* to the work-storing pockets 9, if relative positions of the transfer grooves 14*c* and the work-storing pockets 9 is changed by the rotation of the conveyor table 7, the works W would not interfere the inclined surfaces of the transfer grooves 14*c*, because the conveyor table 7 is upwardly rotated in a vicinity of the transfer grooves 14*c*.

The work-storing pockets 9 passing through the conveyor table 7 are in communication with the vacuum sucking grooves 18 disposed concentrically on the table base 8 through the sucking grooves 9*a* which are in communication with the work-storing pockets 9 and are disposed on the rear surface of the conveyor table 7. Thus, the works W which reach the end of the transfer groove 14*c* of the distribution chute 14, are smoothly sucked and loaded in the work-storing pockets 9 in which a negative pressure is produced by the vacuum sucking grooves 18.

When the works W are not stored in the work-storing pockets 9, it can be considered that the sucking grooves 9*a* and the sucking grooves 18 are opened to an atmosphere to lower a degree of vacuum thereof, which causes a reduction of sucking force of the other storing pockets 9. In order to prevent this situation, according to this embodiment, each sucking groove 9*a* has a small sectional area. Thus, a resistance of a flow channel is increased, so that the lowering of degree of vacuum in each sucking groove 18 can be prevented (FIG. 10).

A plurality of sucking holes 22 are disposed on the table base 8 to correspond the reservoir space S formed by the distribution chute 14. In addition to the negative pressure of the work-storing pockets 9 caused by the annular sucking grooves 18, the negative pressure of the work-storing pockets 9 in a vicinity of the distribution chute 14 is further produced by a vacuum sucking of the sucking holes 22. Thus, the works W can securely be loaded in the work-storing pockets 9.

Referring to FIG. 9, a loading operation of the works W in the work-storing pockets 9 is further described below. As shown in FIG. 9, of the works W positioned close to each other in the transfer groove 14*c* of the distribution chute 14, the headmost work W in contact with a surface of the conveyor table 7 is rotated in a direction indicated by the arrow L of the conveyor table 7, that is, in a direction from the distribution chute 14 to the inspection apparatus 17 (from down to up at a position of the distribution chute 14), and thus a frictional force is generated. When the upper work W is moved upward by the frictional force, a narrow gap is formed between the upper work W and the lower work W positioned below. Thus, there is no or little force compressing from above, and therefore the headmost work W in the transfer groove 14*c* is so positioned that the edge of the conveyor groove 14*c* and the longitudinal direction of the work W are conformed with each other. Thus, the work W can be provided correctly the transfer groove 14*c*. In this way, the works W can easily and securely be loaded in the work-storing pockets 9. Due to a friction between the unloaded works W and the conveyor table 7, the works W can be slightly agitated. Thus, the works W are easily arranged in line.

The works W loaded in the work-storing pockets 9 are sucked by the negative pressure of the sucking grooves 18 to hold their loading postures. After the work sensor 20 detects whether or not the works W are loaded in the work-storing pockets 9, the works W are conveyed to the work inspection apparatus 17.

The works W which are conveyed to the work inspection apparatus 17, are sandwiched to be inspected by the base probes 36 and the inspection probes 32, with respect to every inspection item such as capacitance, insulation resistance, withstanding voltage, dissipation factor, and so on. Data obtained by the work inspection apparatus 17 are sent to the controller 5 through the signal cable 37, and sorted according to a property.

Then, the works W are conveyed to the sorting and ejecting part 12, the controller 5 controls compressed air from the jet hole 25 selected based on the inspection data so as to blow out the works W loaded in the work-storing pockets 9 to the ejection pipe 39.

The works in the ejection pipe 39 are then carried through the ejection hose 38, ejection hose receiving plate 40, the ejection junction plate 41, and the ejection pipe 43, and are then stored in the storing box 4.

When a defective work W such as chipped work W is mixed in the works W when being conveyed by the conveyor table 7, the defective work W is not loaded in the work-storing pocket 9, but instead is fallen down to the V-shaped portion formed in the lower part of the inner periphery of the guide 10. The fallen work W is then sent to the ejection hole 24 by the compressed air emitted from the jet nozzle 30 of the cover unit 11 so that the work W is ejected outward (FIG. 3). It is expected that all the works W loaded in the work-storing pockets 9 are ejected by the sorting and ejecting part 12. However, if the works W are not ejected, but instead remained in the work-storing pockets 9, the work sensor 28 detects the remained works W to take a necessary action such as stopping of the system.

In this embodiment, operations for changing the work size or maintaining the system are efficiently carried out. That is, in detaching the conveyor table 7 for the replacement thereof from the table base 8, as shown in FIG. 14, the switch button 27 disposed on the guide 10 is pressed to open the mechanical valve 27*a*. Then, compressed air is supplied to the cylinder 28*a* through the air pipe 48 to project the pusher 28. Thus, the conveyor table 7 is pushed from the rear surface thereof, and is detached from the table base 8.

When replacing the base probes 36 or adjusting the height thereof, as shown in FIGS. 11 and 12, the clamp screw 33 is inserted in the through-hole of the table base 8, and is rotated. Due to this rotation of the clamp screw 33, the eccentric cam 34 disposed on a part of the clamp screw 33 is also rotated. Then, the clamp bar 35 disposed in the slide groove 35*a* of the base 6 is slidably moved, so that the base probes 36 can be detached or clamped.

SECOND EMBODIMENT

Figure 15:
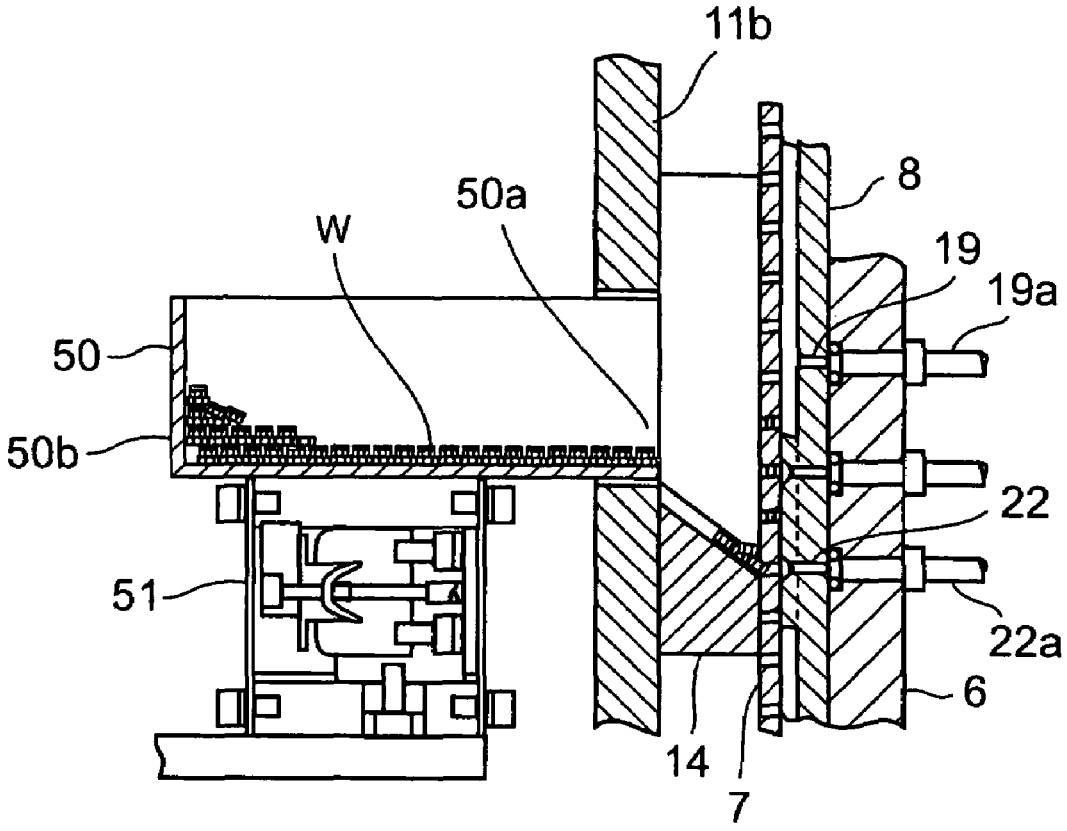
FIG. 15 is a view showing a second embodiment of a work inspection system according to the present invention.
Figure 16:
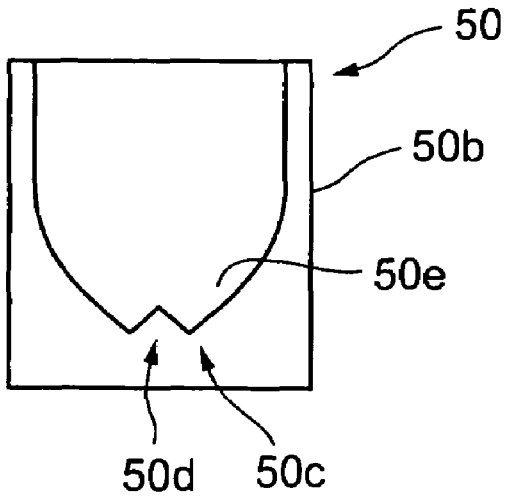
FIG. 16 is a view showing another embodiment of a work inspection system.

Referring to FIGS. 15 and 16, a second embodiment of the present invention is described below.

The second embodiment shown in FIG. 15 does not include the guide chute 13 downwardly inclined, but instead includes a horizontally extending linear chute 50 for supplying the works W, which is connected to the hopper 3 (FIG. 1). The linear chute 50 is inserted into the cover unit 11 through a cut-hole of the cover plate 11*b*. Thus, the works W can directly be supplied to the upper part of the distribution chute 14 from an end opening 50*a* of the linear chute 50. The horizontal linear chute 50 has a V-shaped chute body 50*b* to which a vibrator (driving mechanism) 51 is connected so as to carry the works W forward.

As shown in FIG. 16, a V-shaped transfer groove 50*e* may be formed at a bottom of the chute body 50*b* of the horizontally linear chute 50. The V-shaped transfer groove 50*e* is formed by, similar to the distribution chute 14, recessed portions 50*c* and a projected portion 50*d*. An end of the chute body 50*b* is opposed to a surface of the conveyor table 7. A narrow gap is formed between the linear chute body 50*b* and the surface of the conveyor table 7. The gap is formed such that the works W would not be caught in the gap when the works W are transferred to the conveyor table 7. In addition, the chute body 50*b* vibrated by the vibrator 51 would not contact the conveyor table 7. In this way, both the downwardly inclined guide chute 13 and the distribution chute 14 can be eliminated, and the works W in the horizontal linear chute 50 may directly be transferred to the work-storing pockets 9 of the conveyor table 7.

Although FIG. 15 does not show means for detecting an amount of the supplied works W, the same detecting means as that of FIG. 7 can be provided to control a supply amount.

In FIG. 15, the downwardly inclined distribution chute 14 is used, and the works W are guided by the distribution chute 14 to the work-storing pockets 9. Thus, the works W can securely be loaded in the work-storing pockets 9. On the other hand, when a guide chute 13 having a flat work channel (bottom) is used, it might be difficult to store the works W in the work-storing pockets 9, because the orientations of the works cannot be accurately determined. In order to prevent this state, it might be possible to generate a forced agitation by air. In this case, however, the works W may collide with each other, which results in a defectiveness of the works W such as abrasion and chipping. In addition, even if agitating the works W, the orientations thereof would be still random and unstable. In the embodiment shown in FIG. 15, since the works W can smoothly be guided to the work-storing pockets 9 through the distribution chute 14, a forced agitation by air is not needed.

In the embodiment shown in FIG. 16, the transfer groove 50*e* is formed on the bottom of the chute body 50*b*. The transfer groove 50*e* is formed by the recessed portions 50*c* and the projected portion 50*d*, and has a V-shaped cross section whose opening degree being equal to or more than 90°. The end opening 50*a* of the chute body 50*b* faces the conveyor table 7. The narrow gap is formed between the conveyor table 7 and the chute body 50*b*, but the works W would not be caught in the gap. In addition, the vibration of the chute body 50*b* would not affect the conveyor table 7 because of the gap. Thus, the works W in the linear chute 50 can directly be supplied to the conveyor table 7, and thus the distribution chute 14 can be eliminated.

In the above respective embodiments, the number of the concentric lines of the plurality of work-storing pockets 9 on which they are disposed, is two. However, the number of lines may be three or four. The number of inspection items of the works inspected by the inspection apparatus 17, and the number of assortments sorted by the sorting and ejecting part 12 can be varied according to need.

The cover plate 11*b* is formed by a substantially transparent body in order to easily recognize the presence of the works W on the conveyor table 7. However, the cover plate 11*b* may be opaque and have means such as inspection hole or the like for recognizing the presence of the works W.

In addition, although each work-storing pocket 9 is of square shape in the above embodiments, a shape thereof may be of round shape. Since the vacuum sucking grooves 18 and the storing pockets 9 are in communication with each other through the sucking grooves 9*a* each having a small cross sectional area. Thus, when the works W are not stored in the work-storing pockets 9 to be opened to an atmosphere, a reduction of degree of vacuum in the sucking grooves 18 can be limited by means of a resistance of a flow channel. When replacing the conveyor table 7 with the other one having the work-storing pockets 9 of different size according to the works W of different size, the length of each sucking groove 9*a* compensates a difference of the size of the storing pockets 9.

EFFECTS OF THE INVENTION

As described above, according to the present invention, work-storing pockets of a conveyor table are disposed inside the periphery of the conveyor table to surround works from the circumference. Thus, the works can stably be conveyed, while holding the works by the work-storing pockets of the conveyor table. Since the conveyor table is vertically positioned, the whole system can compactly be configured in a horizontal direction.

In addition, since the works are supplied to the work-storing pockets by V-shaped transfer grooves, the orientations of the works can be corrected and a storing efficiency can significantly be enhanced.

What is claim is:

1. A work inspection system comprising:

a conveyor table vertically positioned, and including a plurality of work-storing pockets for storing works, the work-storing pockets being formed inside the periphery of the conveyor table;

a work supply apparatus for supplying the works to the conveyor table;

a work inspection apparatus for inspecting the works stored in the work-storing pockets of the conveyor table, the work inspection apparatus being disposed near the conveyor table; and a sorting and ejecting apparatus for sorting the inspected works stored in the work-storing pockets of the conveyor table in accordance with a property of the works and ejecting the same;

wherein the work-storing pockets of the conveyor table are positioned along one or more concentric circles;

wherein the work inspection apparatus has a pair of probes being capable of contacting the works in the work-storing pockets from the front and rear surfaces of the conveyor table, and wherein the probe on the rear surface side of the conveyor table is held in place by a clamp bar which is slid along a slide groove disposed on the base.

2. A work inspection system according to claim 1, wherein a table base is disposed on a rear surface of the conveyor table, and circumferential vacuum sucking grooves, which are in communication with the work-storing pockets of the conveyor table and in communication with a vacuum system, are formed in the table base.

3. A work inspection system according to claim 2, wherein the work-storing pockets of the conveyor tables are in communication with the vacuum sucking grooves of the table base through communication grooves.

4. A work inspection system according to claim 1, wherein the work supply apparatus includes an inclined guide chute for supplying the works, which is downwardly inclined to the conveyor table; and a distribution chute for introducing the works from the inclined chute to the work-storing pockets.

5. A work inspection system according to claim 1, wherein the work supply apparatus includes a horizontal guide chute for supplying the works, which is horizontally extended to the conveyor table; and a distribution chute for introducing the works from the horizontal guide chute to the work-storing pockets.

6. A work inspection system according to claim 5, wherein a driving mechanism for driving the works in the horizontal guide chute is disposed on the horizontal guide chute.

7. A work inspection system according to claim 4, wherein the distribution chute has V-shaped transfer for transferring the works to the work-storing pockets.

8. A work inspection system according to claim 1, wherein the work supply apparatus includes the horizontal guide chute for supplying the works, which is horizontally extended to the conveyor table, and wherein the horizontal guide chute has V-shaped transfer grooves for transferring the works to the work-storing pockets.

9. A work inspection system according to claim 7, wherein each V-shaped groove has a V-shaped cross-section whose opening degree is equal to or more than 90°.

10. A work inspection system according to claim 4, wherein the work supply apparatus further includes means for detecting a remaining amount of the works in the distribution chute.

11. A work inspection system according to claim 1, wherein the probe on the rear surface side of the conveyor table is supported by the base which is disposed on the rear surface of the conveyor table through the table base.

12. A work inspection system according to claim 1, wherein the probe on the rear surface side of the conveyor table is slid on the base by a rotation of an eccentric cam.

13. A work inspection system according to claim 1, wherein the sorting and ejecting apparatus includes means for jetting air to the works in the work-storing pockets, the means being disposed on the rear surface side of the conveyor table.

14. A work inspection system according to claim 2, wherein a pusher for pushing the conveyor table to disengage the same from the table base is disposed on the rear surface side of the conveyor table.

* * * * *